US005516101A

United States Patent [19]

Peng

[11] Patent Number: 5,516,101

[45] Date of Patent: May 14, 1996

[54] GAME RACKET HANDLE

[76] Inventor: Jung-Ching Peng, 205-2, 4 Sec. Tien Chin Rd.,, Tai Chung Taiwan, Taiwan

[21] Appl. No.: 18,362

[22] Filed: Feb. 16, 1993

[51] Int. Cl.[6] ..... A63B 49/08

[52] U.S. Cl. ..... 273/73 J; 473/299

[58] Field of Search ..... 273/73 R, 73 J, 273/75, 81 R, 81 D, 81.2

[56] References Cited

U.S. PATENT DOCUMENTS

| | | | |
|---|---|---|---|
| 3,931,968 | 1/1976 | Hedberg | 273/735 |
| 4,674,747 | 6/1987 | Mazzocco et al. | 273/81.2 |
| 4,943,058 | 7/1990 | Carbonetti | 273/735 |
| 5,029,860 | 7/1991 | Ehrich | 273/81.2 |
| 5,083,779 | 1/1992 | Ingermann | 273/81.2 X |
| 5,131,652 | 7/1992 | Peng | 273/735 |
| 5,143,373 | 9/1992 | Meisser | 273/735 X |
| 5,169,145 | 12/1992 | Jang | 273/735 |

FOREIGN PATENT DOCUMENTS

| | | | |
|---|---|---|---|
| 3706554 | 9/1988 | Germany | 273/735 |
| 3941411 | 8/1990 | Germany | 273/735 |

*Primary Examiner*—William Stoll

[57] ABSTRACT

A game racket handle comprises a shaft extending from a head frame of a game racket and a hand grip attached movably to the rear end of the shaft. An elastic bushing is disposed between the shaft and the hand grip. The hand grip is of hollow construction and is so dimensioned as to receive therein an elastic element which is fitted over the rear end of the shaft. Located at the rear end of the shaft is a through slot which is dimensioned to receive therein an insertion pin for locating the hand grip and which has a length corresponding to a maximum moving distance of the hand grip in the direction of the axis of the shaft. When the head frame of the game racket hits the ground accidentally, the impact force transmitted from the head frame to the shaft is dispersed in the direction of the axis of the shaft, without being transmitted to the hand grip.

5 Claims, 4 Drawing Sheets

GAME RACKET HANDLE

FIELD OF THE INVENTION

The present invention relates generally to a game racket, and more particularly to a game racket having a handle which is provided with a shock-absorbing means capable of attenuating the vibrational force of a shaft of the game racket.

BACKGROUND OF THE INVENTION

In general, the prior art method of providing a game racket handle with a shock-absorbing means involves the use of an elastic shock-absorbing material, which is located securely in a space between the shaft and the hand grip, as exemplified by the U.S. Pat. No. 4,203,596. The prior art method mentioned above is defective in that the shock-absorbing means can not attenuate effectively the axially-transmitted vibrational force of the shaft, and that most of the vibrational force is therefore transmitted to the hand grip, thereby subjecting a player's hand holding the game racket to an injury caused by the shock wave. Another U.S. Pat. No. 5,131,652 discloses a game racket having a shaft which is mounted in a hand grip such that there is a clearance between the outer wall surface of the shaft and the inner wall surface of the hand grip. The clearance serves the purpose of preventing the vibrational energy of the shaft from transmitting to the hand grip. The "clearance method" described above is effective in preventing the transmission of the shock wave from the shaft to the hand grip. However, it occurs from time to time that a player makes an effort to return a fast ball in a desperate manner that the head frame of the game racket hits hard accidentally the ground, as illustrated in FIG. 4. When such an incident takes place, the force of impact exerting on the shaft can be transmitted from the shaft to the hand grip, thereby causing an injury to a player's hand holding the hand grip. In addition, the game racket handle disclosed in the above-mentioned U.S. Pat. No. 5,131,652 is defective in design in that its shaft and hand grip are located axially in the handle in a confinement manner.

SUMMARY OF THE INVENTION

It is therefore the primary objective of the present invention to provide a game racket with an improved handle capable of dispersing the impact force of the shaft, which exerts axially on the hand grip.

The foregoing objective of the present invention is attained by a game racket handle, which comprises a shaft extending outwardly from the head frame and a hand grip fitted over the rear end of the shaft in such a manner that there is a gap of an appropriate width and located between the outer wall surface of the shaft and the inner wall surface of the hollow hand grip. The axial hole of the hollow hand grip is so dimensioned as to receive therein an elastic element compressible axially. The shaft has a rear end provided therein with an elongate through slot parallel to the axis of the shaft and having a length corresponding to a moving distance of the hand grip which moves axially in relation to the shaft. The shaft is located in the hand grip by means of a pin, which is disposed in the through slot. The rear end of the shaft is fitted into a sleeve having an outer diameter smaller than the inner diameter of the axial hole of the hand grip. The front end of the hand grip is fitted into an elastic sleeve of a shock-absorbing material. The shaft is movably disposed in the hand grip such that the vibrational force exerting on the shaft is dispersed effectively.

DETAILED DESCRIPTION OF THE INVENTION

Figure 1:
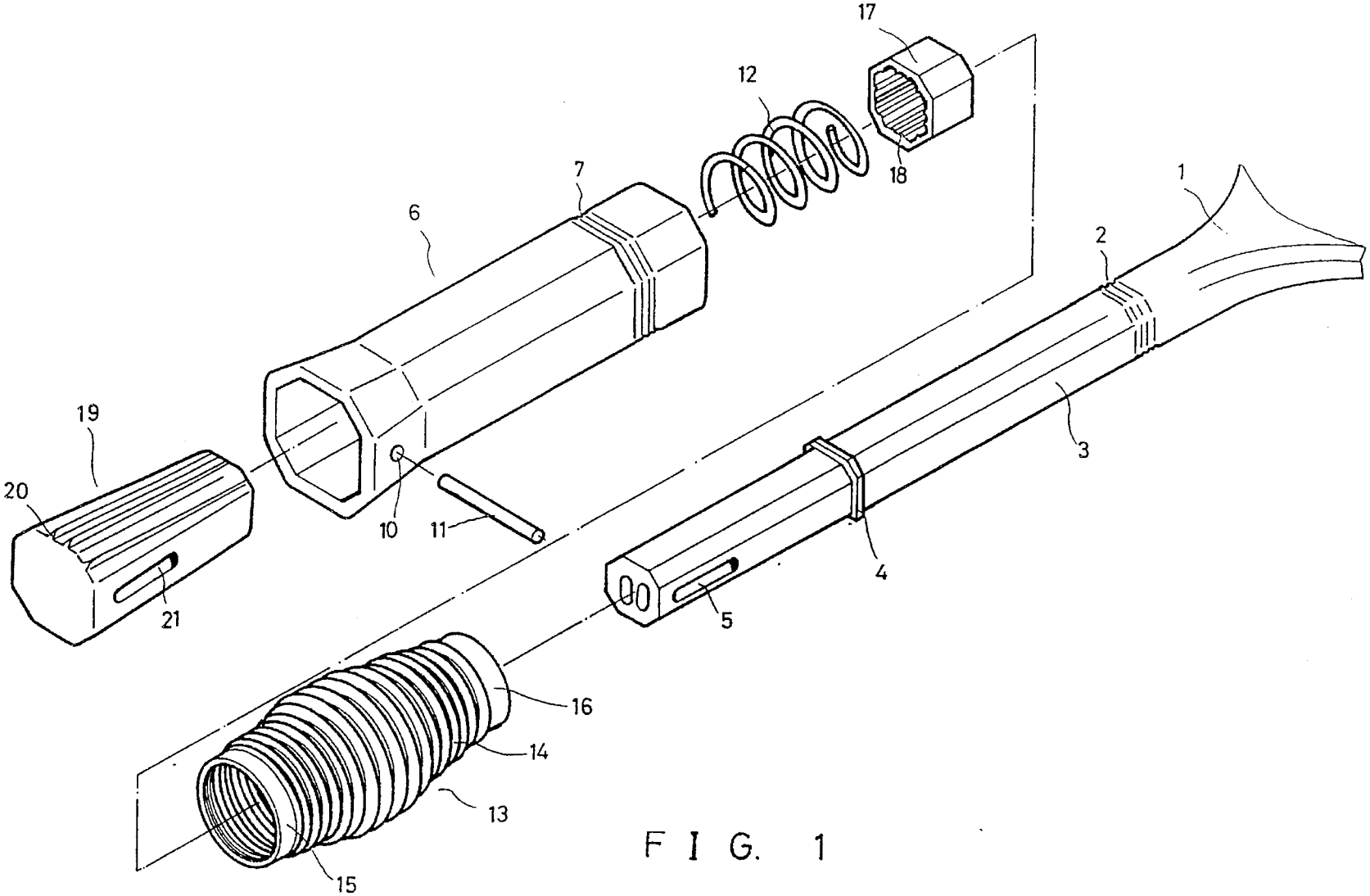
FIG. 1 shows an exploded view of a game racket handle of the present invention.

Referring to FIG. 1, a game racket handle embodied in the present invention is shown to comprise mainly a shaft 1 and a hand grip 6.

The shaft 1 is provided thereon at the front end thereof with a narrow threaded area 2 circumventing the front end of the shaft 1. The segment located behind the threaded area 2 is a rod body 3 having a diameter which becomes progressively smaller from the front end thereof toward the rear end thereof. The rod body 3 is provided thereon in the proximity of the rear end thereof with a stopping flange 4. In addition, the rod body 3 is provided at the rear end thereof with a through slot 5 of a predetermined dimension and parallel to the axis of the rod body 3.

Figure 2:
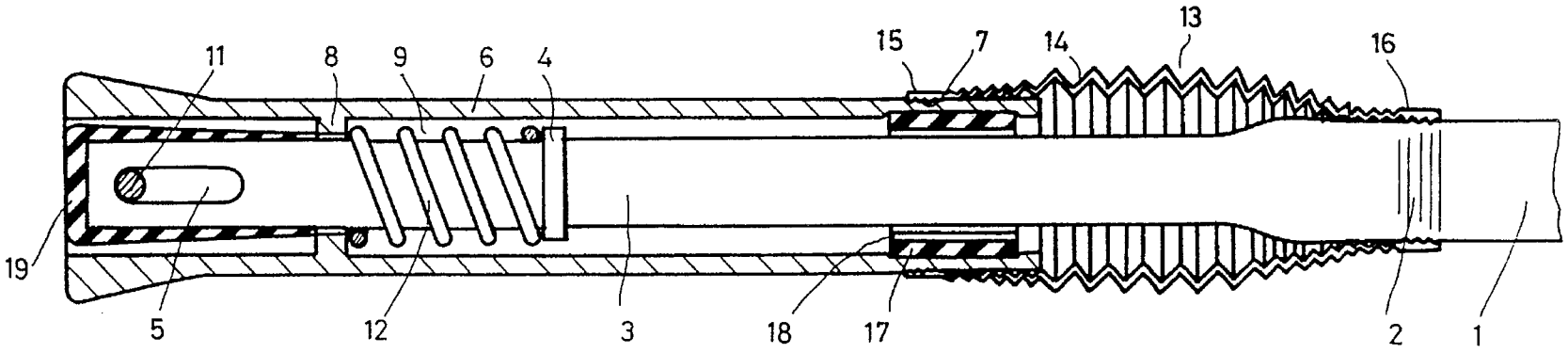
FIG. 2 shows a sectional view of the game racket handle in combination, according to the present invention as shown in FIG. 1.

The hand grip 6 of hollow construction is octagonal in its cross section and is so dimensioned as to fit over the shaft 1 in such a manner that there is an appropriate clearance between the inner wall surface of the hand grip 6 and the outer wall surface of the shaft 1. The hand grip 6 is provided thereon at the front end thereof with a narrow threaded area 7. In addition, the hand grip 6 is provided on the inner wall surface of the midpoint thereof with an arresting flange 8, which forms jointly with the stopping flange 4 of the shaft 1 a restricting space 9, as shown in FIG. 2. Located in the wall of the rear end of the hand grip 6 is a locating hole 10 corresponding in location to the through slot 5 of the shaft 1. As a result, the hand grip 6 can be caused to move in the direction of the axis of the shaft 1. However, the maximum moving distance of the hand grip 6 is corresponding to the length of the through slot 5 of the shaft 1.

An elastic element 12, such as a compression spring used in the preferred embodiment of the present invention, is arranged in the restricting space 9 located between the stopping flange 4 of the shaft 1 and the arresting flange 8 of the hand grip 6, as shown in FIG. 2. The elastic element 12 serves as a source of the elastic force enabling the hand grip 6 to move in the direction of the axis of the shaft 1.

As shown in FIGS. 1 and 2, the game racket handle of the present invention is provided with a hollow elastic sleeve 13 of conical construction, which is made of a shock-absorbing material. The elastic sleeve 13 has a front fastening portion 16 and a rear fastening portion 15, which can be respectively fitted over and fastended to the threaded area 2 of the shaft 1 and the threaded area 7 of the hand grip 6, as shown in FIG. 2. Located between the front fastening portion 16 and the rear fastening portion 15 is a bellows 14 capable of expanding or contracting in the direction of the axis of the shaft 1.

The game racket handle of the present invention is further provided with a hollow elastic bushing 17 of octagonal construction, which is made of a shock-absorbing material. The elastic bushing 17 is so dimensioned as to fit securely into the front end of the hand grip 6. In addition, the elastic bushing 17 is provided with a plurality of ribbed portions 18, which are axially arranged on the inner wall surface of the elastic sleeve 13. The elastic bushing 17 is intended for use in reducing the effect of friction between the shaft 1 and the hand grip 6.

The game racket handle of the present invention is still further provided with a rear sleeve 19, which is octagonal in its cross section and is fastened to the rear end of the shaft 1. The rear sleeve 19 is so dimensioned that it has a largest outer diameter which is smaller than the inner diameter of the rear end of the hand grip 6. The rear sleeve 19 is provided on the outer surface thereof with a plurality of ribbed portions 20 parallel to the axis of the rear sleeve 19. The inner wall surface of the rear sleeve 19 is made of a shock-absorbing material while the ribbed portions 20 of the rear sleeve 19 are made of an abrasion-resistant material. The rear sleeve 19 is further provided with a long through hole 21 corresponding in location to the through slot 5 of the shaft 1.

Figure 3:
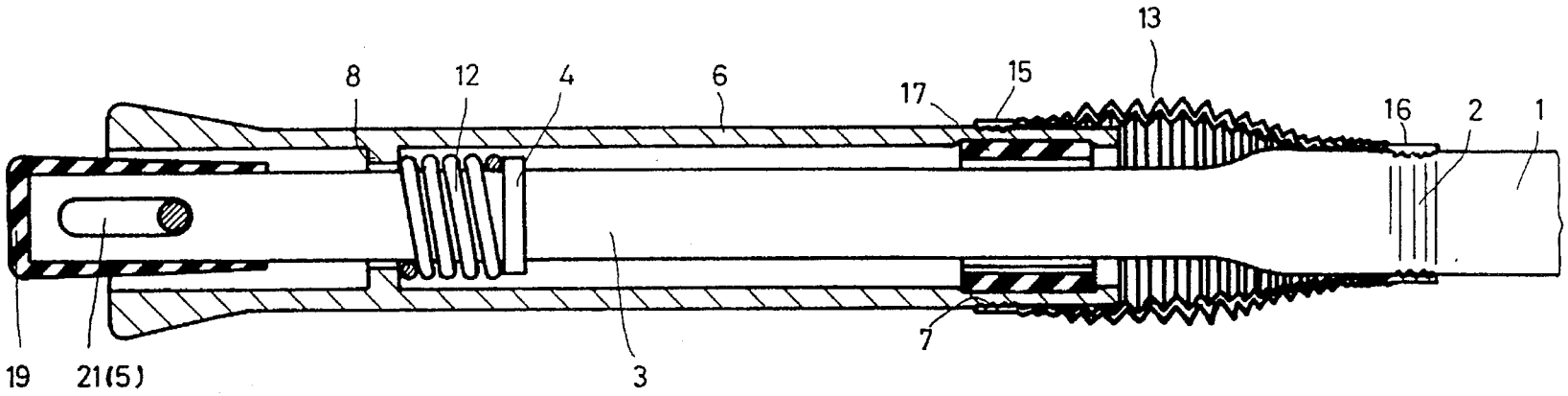
FIG. 3 shows a schematic view of the game racket handle in action, according to the present invention.
Figure 4:
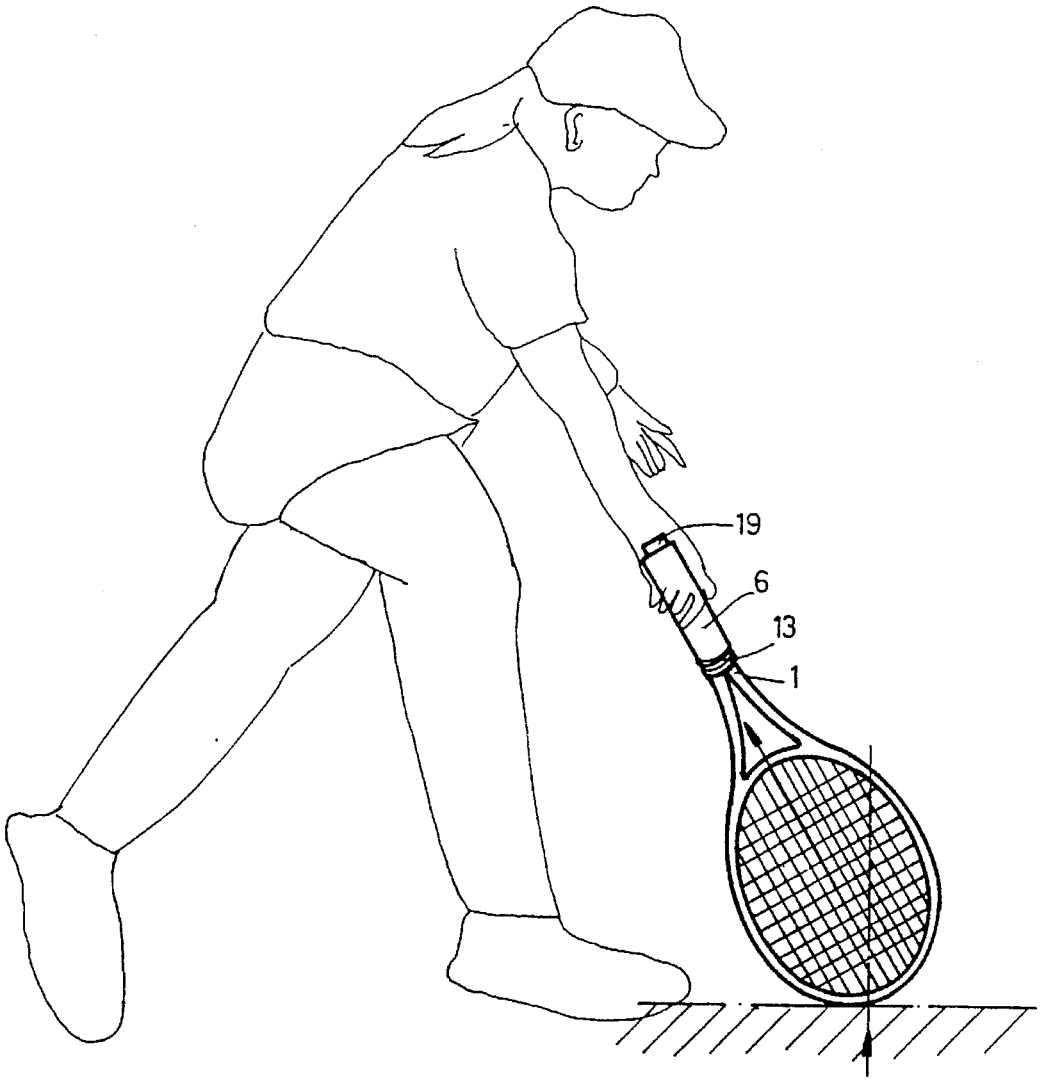
FIG. 4 is a schematic view showing the way that a head frame of a game racket hits the ground accidentally.

The working principles of the present invention are schematically illustrated in FIGS. 3 and 4. The rod body 3 of the shaft 1 has a diameter that is much smaller than an inner diameter of the hand grip 6. In other words, the inner diameter of the hand grip 6 is larger than the largest outer diameter of the rod body 3, which is measured by adding together the rod body 3 and the rear sleeve 19. The effect of friction between the shaft 1 and the hand grip 6 is reduced to a minimum by means of the ribbed portions 18 and 20 of the elastic bushing 17 and the rear sleeve 19. When the shaft 1 is impacted by an external force, the shaft 1 is able to move in the direction of the axis of the hand grip 6 such that the rear end of the rod body 3 of the shaft 1 moves out of and beyond the rear end of the hand grip 6, as shown in FIG. 3. In other words, the elastic element 12 is forced to compress by the stopping flange 4 of the rod body 3 of the shaft 1 and the arresting flange 8 of the hand grip 6. In the meantime, the axial movement of the shaft 1 causes the bellows 14 of the elastic sleeve 13 to contract, thereby resulting in the shortening of the elastic sleeve 13. The through slot 5 of the rod body 3 of the shaft 1 serves the dual purposes of restraining the axial movement of the hand grip 6 and of preventing the hand grip 6 from separating from the shaft 1. The shaft 1 is caused to move axially toward the hand grip 6 at the time when the head frame hits the ground accidentally. Thereafter the shaft 1 is forced by the elastic force of the elastic element 12 to move back to its original position. It is therefore apparent that the force of impact exerting on the shaft 1 is effectively dispersed in the direction of the axis of the hand grip 6. In addition, the shock wave is partially attenuated by the elastic sleeve 13, the elastic bushing 17 and the rear sleeve 19. As a result, a player's hand holding the hand grip 6 is not hurt by the force of impact of the head frame, which is transmitted to the shaft 1.

The embodiment of the present invention described above is to be regarded in all respects as merely illustrative and not restrictive. Accordingly, the present invention may be embodied in other specific forms without deviating from the spirit thereof. Therefore, the present invention is to be limited only by the scope of the following appended claims.

I claim:

1. A game racket handle comprising a shaft extending from a head frame of a game racket and a hand grip attached movably to a rear end of said shaft and provided at a front end thereof with a hollow elastic bushing fitted thereinto; wherein said hand grip is of hollow construction and is so dimensioned as to receive therein a compressible elastic element which is fitted over said rear end of said shaft; wherein said shaft is provided at said rear end thereof with a through slot parallel to an axis of said shaft and dimensioned to receive therein an insertion pin for locating said hand grip, said through slot having a length corresponding to a maximum moving distance of said hand grip in the direction of said axis of said shaft; and wherein said shaft is further provided with a rear sleeve fastened to said rear end thereof and dimensioned to fit into a rear end of said hand grip, and with an elastic sleeve having a front end fitted over said shaft and having a rear end fitted over a front end of said hand grip, said elastic sleeve being compressible and decompressible in the direction of said axis of said shaft.

2. The game racket handle according to claim 1 wherein said elastic element is confined between a stopping flange disposed on an outer wall surface of said shaft and an arresting flange disposed on an inner wall surface of said hand grip.

3. The game racket handle according to claim 1 wherein said elastic sleeve is made of a shock-absorbing material and provided with a bellows disposed between said front end and said rear end of said elastic sleeve.

4. The game racket handle according to claim 1 wherein elastic bushing is provided with a plurality of ribbed portions which are disposed on an inner wall surface thereof such that said ribbed portions are parallel to an axis of said elastic bushing; and wherein said rear sleeve is provided with a plurality of ribbed portions which are disposed on an outer wall surface thereof such that said ribbed portions are parallel to an axis of said rear sleeve.

5. The game racket handle according to claim 1 wherein said front end of said elastic sleeve and said rear end of said elastic sleeve are provided respectively with a front fastening portion and a rear fastening portion, said front fastening portion being fastened securely with a threaded area disposed on an outer wall surface of said front end of said shaft, said rear fastening portion being fastened securely with a threaded area disposed on an outer wall surface of said front end of said hand grip.

* * * * *